US005925504A

United States Patent [19]

Fyson

[11] Patent Number: 5,925,504

[45] Date of Patent: Jul. 20, 1999

[54] METHOD OF FORMING A PHOTOGRAPHIC COLOR IMAGE

[75] Inventor: John Richard Fyson, Hackney, United Kingdom

[73] Assignee: Eastman Kodak Company, Rochester, N.Y.

[21] Appl. No.: 08/953,941

[22] Filed: Oct. 20, 1997

Related U.S. Application Data

[63] Continuation-in-part of application No. 08/684,897, Jul. 25, 1996, abandoned.

[30] Foreign Application Priority Data

Jul. 28, 1995 [GB] United Kingdom ..... 9515515.6

[51] Int. Cl.[6] ..... G03C 7/42

[52] U.S. Cl. ..... 430/393; 430/373; 430/414; 430/430; 430/943

[58] Field of Search ..... 430/373, 393, 430/414, 430, 461, 943

[56] References Cited

U.S. PATENT DOCUMENTS

| | | | |
|---|---|---|---|
| 5,324,624 | 6/1994 | Twist | 430/943 |
| 5,387,499 | 2/1995 | Earle et al. | 430/399 |
| 5,547,816 | 8/1996 | Fyson et al. | 430/393 |
| 5,550,009 | 8/1996 | Haye et al. | 430/430 |

FOREIGN PATENT DOCUMENTS 2 303 931 3/1997 United Kingdom .

*Primary Examiner*—Hoa Van Le
*Attorney, Agent, or Firm*—J. Lanny Tucker

[57] ABSTRACT

A silver halide material can be processed using a redox amplification developer solution and a bleach solution. Both solutions contain a peroxide oxidant.

13 Claims, No Drawings

METHOD OF FORMING A PHOTOGRAPHIC COLOR IMAGE

CROSS REFERENCE TO RELATED APPLICATION

This is a continuation-in-part of application Ser. No. 08/684,897 filed Jul. 25, 1996, entitled: Method of Forming A Photographic Color Image.

FIELD OF THE INVENTION

The invention relates to a method of forming a color photographic image by a redox amplification method. In particular, this invention relates to processing low silver photographic materials in a redox amplifying developer followed immediately by a bleach step.

BACKGROUND OF THE INVENTION

Redox amplification processes have been described, for example in British Specification Nos. 1,268,126, 1,399,481, 1,403,418 and 1,560,572. In such processes, color materials are developed to produce a silver image (which may contain only small amounts of silver) and are then treated with a redox amplifying solution (or a combined developer-amplifier) to form a dye image.

The developer-amplifier solution contains a color developing agent and an oxidizing agent that will oxidize the color developing agent in the presence of the silver image which acts as a catalyst.

Oxidized color developer reacts with a color coupler to form the image dye. The amount of dye formed depends on the time of treatment or the availability of color coupler and is less dependent on the amount of silver in the image as is the case in conventional color development processes.

Examples of suitable oxidizing agents include peroxy compounds including hydrogen peroxide and compounds that provide hydrogen peroxide, e.g., addition compounds of hydrogen peroxide; cobalt (III) complexes including cobalt hexammine complexes; and periodates. Mixtures of such compounds can also be used.

The image-forming step can be followed by a stop bath, bleach and fix, although the bleach and/or fix may be omitted if the silver coating weight of the material processed is low enough. Recently it has been proposed that the bleach bath may contain a peroxide as sole bleaching agent. Such proposals have carried the warning that redox amplification has to be stopped before bleaching otherwise color staining will occur due to image formation continuing in the peroxide bleach solution.

There is a continuing need to reduce photographic processing times. This is desirable as it means that processing throughput can be increased. The customer is equally pleased because he can see the results a little sooner.

SUMMARY OF THE INVENTION

According to the present invention there is provided a method of forming a photographic image comprising:

A) color developing an imagewise exposed photographic silver halide material with a redox amplification developer solution comprising an oxidant, and B) bleaching the material with a bleach solution comprising hydrogen peroxide or a compound that releases hydrogen peroxide during processing, and an alkali metal halide, wherein step B) follows step A) without an intermediate processing step, and image formation by redox amplification continues during bleaching.

According to this invention, the processing time can be reduced while at the same time better colors are obtained. The effluent from the process contains no iron as it would if a conventional ferric EDTA bleaching agent were used. The overall chemical oxygen demand of the process is reduced. Without the alkali metal halide in the bleach solution the emulsion layers of the treated material are destroyed by the formation of oxygen bubbles. In addition, stain is formed without the halide.

Preferably the time of bleaching in the present invention is less than the time used for the devamp step. Particularly, the bleach time is less than one-half the time for the devamp step, and more preferably, the bleaching time is one-third or less than the time of the devamp step.

DETAILED DESCRIPTION OF THE INVENTION

Preferably the oxidant of the redox amplification step is hydrogen peroxide or a compound that releases hydrogen peroxide during processing.

The present bleach solutions preferably contain an alkali metal halide at a concentration of 0.25 to 50 g per liter, preferably 0.5 to 35 g per liter, more preferably 1 to 30 g per liter. In the absence of halide the bleach solution forms oxygen bubbles in the material being processed and removes the emulsion layers of the material from the support.

The present bleach baths preferably contain 30% hydrogen peroxide at concentrations of from 10 to 300 ml/l, preferably from 20 to 100 ml/l (when provided as a 30% solution). Preferably hydrogen peroxide is the sole oxidant of the bleach.

The present bleach baths preferably have a pH of from 8 to 11.5, preferably from 9 to 11.

A particular application of this technology is in the processing of silver chloride color paper, for example paper whose silver halide comprises at least 85 mole percent silver chloride, especially such paper with low silver levels, for example silver levels below 30 mg/m$^2$, preferably below 20 mg/m$^2$, especially within the range of 1 to 20 mg/m$^2$.

The photographic materials can be black-and-white, single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

Suitable materials for use in the emulsions and elements processed by the method of this invention, are described in Research Disclosure Item 36544, September 1994, published by Kenneth Mason Publications, Emsworth, Hants, United Kingdom.

The present processing method is preferably carried out by passing the material to be processed through a tank containing the processing solution that is recirculated through the tank at a rate of from 0.1 to 10 tank volumes per minute.

The method of this invention is generally carried out using a redox amplification dye image-forming or devamp step of from about 15 to about 120 seconds, and preferably for from about 20 to about 60 seconds. The bleach step is generally at least about 5 seconds, with a time of from about 7 to about 20 seconds being preferred. As noted above, it is preferred that the bleach step be less than one-half the time for the devamp step, and more preferably, that it is one-third or less of the devamp time.

The preferred recirculation rate is from 0.5 to 8, especially from 1 to 5 and particular from 2 to 4 tank volumes per minute.

The recirculation, with or without replenishment, is carried out continuously or intermittently. In one method of working both could be carried out continuously while processing was in progress but not at all or intermittently when the machine was idle. Replenishment may be carried out by introducing the required amount of replenisher into the recirculation stream either inside or outside the processing tank.

It is advantageous to use a tank of relatively small volume. Hence in a preferred embodiment of the present invention the ratio of tank volume to maximum area of material accommodatable therein (i.e., maximum path length×width of material) is less than 11 $dm^3/m^2$, preferably less than 3 $dm^3/m^2$.

The shape and dimensions of the processing tank are preferably such that it holds the minimum amount of processing solution while still obtaining the required results. The tank is preferably one with fixed sides, the material being advanced therethrough by drive rollers. Preferably the photographic material passes through a thickness of solution less than 11 mm, preferably less than 5 mm and especially about 2 mm. The shape of the tank is not critical but it could be in the shape of a shallow tray or, preferably U-shaped. It is preferred that the dimensions of the tank be chosen so that the width of the tank is the same or only just wider than the width of the material to be processed.

The total volume of the processing solution within the processing channel and recirculation system is relatively smaller as compared to prior art processors. In particular, the total amount of processing solution in the entire processing system for a particular module is such that the total volume in the processing channel is at least 40 percent of the total volume of processing solution in the system. Preferably, the volume of the processing channel is at least about 50 percent of the total volume of the processing solution in the system.

In order to provide efficient flow of the processing solution through the opening or nozzles into the processing channel, it is desirable that the nozzles/opening that deliver the processing solution to the processing channel have a configuration in accordance with the following relationship:

$$0.6 \leq F/A \leq 23$$

wherein:

F is the flow rate of the solution through the nozzle in liters/minute; and

A is the cross-sectional area of the nozzle provided in square centimeters.

Providing a nozzle in accordance with the foregoing relationship assures appropriate discharge of the processing solution against the photosensitive material. Such Low Volume Thin Tank systems and methods of use are described in more detail in the following patent specifications: U.S. Pat. Nos. 5,294,956, 5,179,404, 5,436,118, 5,270,762, EP 559,025, EP 559,026, EP 559,027, WO 92/10790, WO 92/17819, WO 93/04404, WO 92/17370, WO 91/19226, WO 91/12567, WO 92/07302, WO 93/00612, WO 92/07301, and WO 92/09932.

The following Example is included for a better understanding of the invention.

EXAMPLE

The following processing solutions were made up.

| | |
|---|---|
| RX developer/amplifier | |
| 1-hydroxyethylidene-1,1'-diphosphonic acid | 0.6 g |
| diethyltriaminepentaacetic acid | 2.0 g |
| Dipotassium hydrogen phosphate | 40.0 g |
| Hydroxylamine sulfate | 0.5 g |
| 4-N-ethyl-N-(β-methanesulfonamido-ethyl)-o-toluidine sesquisulfate | 4.5 g |
| Hydrogen Peroxide (30%) | 2 ml |
| Water to | 1 liter |
| pH adjusted to 11.7 | |
| Fix/stop | |
| Sodium thiosulfate pentahydrate | 20 g |
| Sodium sulfite anhydrous | 30 g |
| Sodium acetate | 40 g |
| Water to | 1 liter |
| pH adjusted to 5.0 with sulfuric acid at 25° C. | |
| Bleach-fix | |
| Sodium iron(III) EDTA | 75 g |
| Sodium thiosulfate pentahydrate | 75 g |
| Acetic acid | 10 ml |
| Water to | 1 liter |
| pH adjusted to 6.0 at 20° C. with 10% sodium carbonate solution | |
| Bleach 1 | |
| 30% hydrogen peroxide | 50 ml |
| sodium chloride | 1 g |
| sodium hydrogen carbonate | 20 g |
| Water to | 1 liter |
| pH adjusted to 10.0 at 20° C. with 3 molar sodium hydroxide | |
| Bleach 2 | |
| 30% hydrogen peroxide | 50 ml |
| sodium hydrogen carbonate | 20 g |
| Water to | 1 liter |
| pH adjusted to 10.0 at 20° C. with 3 molar sodium hydroxide | |

The solutions described above were use to process a low silver paper containing 19 mg $Ag/m^2$ in red and green sensitive layers and 30 mg $Ag/m^2$ in the blue sensitive layer, exposed to 21 step color wedges for 0.1 sec. The processes carried out were as follows:

| | | |
|---|---|---|
| | Process 1 (Comparison) | |
| Develop | 45 sec | 35° C. |
| Fix/Stop | 45 sec | 35° C. |
| Bleach-Fix | 45 sec | 35° C. |
| Wash | 45 sec | 35° C. |
| Dry | | |
| | Process 2 (Comparison) | |
| Develop | 45 sec | 35° C. |
| Fix/Stop | 45 sec | 35° C. |
| Wash | 45 sec | 35° C. |
| Dry | | |
| | Process 3 (Invention) | |
| Develop | 35 sec | 35° C. |
| Bleach 1 | 10 sec | 35° C. |
| Fix/Stop | 45 sec | 35° C. |
| Wash | 45 sec | 35° C. |
| Dry | | |
| | Process 4 (Comparison) | |
| Develop | 35 sec | 35° C. |
| Bleach 2 | 10 sec | 35° C. |
| Fix/Stop | 45 sec | 35° C. |
| Wash | 45 sec | 35° C. |
| Dry | | |
| | Process 5 (Comparison) | |
| Develop | 35 sec | 35° C. |
| Fix/Stop | 45 sec | 35° C. |
| Wash | 45 sec | 35° C. |
| Dry | | |

After processing, the steps were read and sensitometric parameters calculated.

The following Table 1 summarizes the sensitometry read on the neutral exposed wedge.

TABLE 1

| Process | Dmin | | | Dmax | | | Speed | | | Inertia Speed | | |
|---|---|---|---|---|---|---|---|---|---|---|---|---|
| No. | R | G | B | R | G | B | R | G | B | R | G | B |
| 1 | .095 | .101 | .086 | 2.95 | 2.66 | 2.29 | 133 | 123 | 125 | 150 | 144 | 151 |
| 2 | .097 | .104 | .088 | 2.91 | 2.71 | 2.53 | 137 | 129 | 130 | 153 | 147 | 154 |
| 3 | .101 | .104 | .086 | 2.90 | 2.66 | 2.28 | 142 | 131 | 129 | 162 | 154 | 160 |
| 4 | .143 | .125 | .120 | — | — | — | — | — | — | — | — | — |
| 5 | .092 | .092 | .082 | 2.61 | 2.46 | 1.81 | 129 | 119 | 119 | 148 | 142 | 147 |

| Process | Contrast | | | Shoulder Contrast | | | Toe | | |
|---|---|---|---|---|---|---|---|---|---|
| No. | R | G | B | R | G | B | R | G | B |
| 1 | 4.83 | 3.79 | 3.08 | 2.27 | 2.01 | 1.76 | .196 | .229 | .228 |
| 2 | 4.81 | 4.23 | 3.47 | 2.23 | 2.09 | 1.89 | .196 | .238 | .235 |
| 3 | 4.65 | 4.07 | 3.16 | 2.17 | 2.01 | 1.84 | .197 | .230 | .230 |
| 4 | — | — | — | — | — | — | .214 | .253 | .241 |
| 5 | 4.24 | 3.65 | 2.86 | 1.99 | 1.85 | 1.55 | .192 | .223 | .221 |

The results show that the sensitometry of the invention, Process 3, is similar to the bleach-fixed process but took 45 seconds less time to process. Process 2 shows increased density and contrast due to retained silver. The sensitometry of Process 4 was not complete as the paper was destroyed in high density area by the formation of oxygen bubbles in the film. At low densities without chloride in the bleach, stain was observed. The shorter development time (35 sec) without the bleach following the developer showed low density particularly in the blue sensitive layer, demonstrating that formation of the dye image was continuing in the bleach The following Table 2 summarizes the Dmin and Dmax read on the blue exposed wedge. This shows the amount unwanted color contamination due to retained silver.

TABLE 2

| | Dmin | | | Dmax | | |
|---|---|---|---|---|---|---|
| Process No. | R | G | B | R | G | B |
| 1 | 0.089 | 0.098 | 0.084 | 0.14 | 0.54 | 2.20 |
| 2 | 0.094 | 0.104 | 0.091 | 0.28 | 0.68 | 2.31 |
| 3 | 0.090 | 0.102 | 0.085 | 0.16 | 0.57 | 2.20 |
| 4 | 0.143 | 0.120 | 0.121 | — | — | — |
| 5 | 0.087 | 0.098 | 0.082 | 0.27 | 0.69 | 2.12 |

In the Dmax area of Processes 2 and 5 without bleach (comparative) high red and green densities are observed in the blue exposed patches due to retained silver that results in color degradation of the yellow layer particularly at high densities. Most of this increased gray density is removed by process 3 (the invention), in which the result is similar to the long process time Process 1 (comparative). Processes 1 and 3 give 'brighter' yellows.

The invention has been described in detail with particular reference to preferred embodiments thereof, but it will be understood that variations and modifications can be effected within the spirit and scope of the invention.

I claim:

1. A method of forming a photographic image comprising:

A) color developing an imagewise exposed photographic silver halide material with a redox amplification developer solution comprising an oxidant, and B) bleaching said material with a bleach solution comprising hydrogen peroxide or a compound that releases hydrogen peroxide during processing, and an alkali metal halide, wherein step B) follows step A) without an intermediate processing step, and image formation by redox amplification continues during bleaching, and wherein the time for bleaching step B is one-third or less than the time for devamp step A.

2. The method of claim 1 wherein said oxidant in said developer solution is hydrogen peroxide or a compound which releases hydrogen peroxide during processing.

3. The method of claim 1 wherein said bleach solution contains said alkali metal halide at a concentration of from 0.25 to 50 g per liter.

4. The method of claim 3 wherein said bleach solution contains said alkali metal halide at a concentration of from 0.5 to 35 g per liter.

5. The method as claimed in any of claim 1 wherein said bleach solution has a pH of from 9 to 11.

6. The method of claim 1 wherein said photographic silver halide material is a silver chloride color paper comprising a silver halide emulsion comprising at least 85 mole percent silver chloride.

7. The method of claim 6 wherein the total silver halide coverage in said photographic material is less than or equal to 30 mg/silver per $m^2$.

8. The method of claim 7 wherein the total silver halide coverage is from 1 to 20 mg silver per $m^2$.

9. The method of claim 1 carried out by passing said material through a tank containing either said developer or bleach solution that is recirculated through said tank at a rate of from 0.1 to 10 tank volumes per minute.

10. The method of claim 1 carried out in a processing machine wherein the ratio of tank volume to maximum area of material accommodatable therein is less than 11 $dm^3/m^2$.

11. The method of claim 10 wherein the ratio of tank volume to maximum area of material accommodatable therein is less than 3 $dm^3/m^2$.

12. The method of claim 1 wherein said bleach solution comprises 10 to 300 ml hydrogen peroxide (30%) per liter.

13. The method of claim 9 wherein either said developer or bleach solution is recirculated through said tank at a rate of from 0.5 to 8 tank volumes per minute.

* * * * *